US005435612A

United States Patent [19]

Kreiser

[11] Patent Number: 5,435,612

[45] Date of Patent: Jul. 25, 1995

[54] EAVES TROUGH CLEANER

[76] Inventor: Lois A. Kreiser, 152 Witmer Ave., Elkhart, Ind. 46516

[21] Appl. No.: 130,914

[22] Filed: Jan. 7, 1994

[51] Int. Cl.[6] ..... E04D 13/076

[52] U.S. Cl. ..... 294/19.1; 15/236.04; 294/55

[58] Field of Search ..... 294/1.3, 19.1, 49, 55, 294/55.5; 15/236.04, 236.08

[56] References Cited

U.S. PATENT DOCUMENTS

| | | | |
|---|---|---|---|
| 1,263,949 | 4/1918 | Singer | 294/49 |
| 2,299,418 | 10/1942 | Thomas | 294/55 |
| 3,094,348 | 6/1963 | Preziosi | 294/55.5 |
| 3,626,542 | 12/1971 | Despain et al. | 294/19.1 X |
| 3,972,552 | 8/1976 | Earp | 294/19.1 |
| 4,196,927 | 4/1980 | Lomaga | 294/19.1 |
| 4,310,940 | 1/1982 | Moore | 294/19.1 X |
| 4,447,927 | 5/1984 | Malless | 294/19.1 X |

FOREIGN PATENT DOCUMENTS

| | | | |
|---|---|---|---|
| 1559925 | 1/1980 | United Kingdom | 294/19.1 |
| 2204105 | 11/1988 | United Kingdom | 15/236.04 |

*Primary Examiner*—Johnny D. Cherry
*Attorney, Agent, or Firm*—Brett A. Schenck

[57] ABSTRACT

A tool for cleaning an eaves trough having a scoop portion comprising a flat rectangular bottom, an upstanding back wall and opposite side walls. The bottom and side walls have a plurality of teeth formed at the front ends with two of the teeth on the bottom extending longer than the remaining teeth. The scoop portion is attached at one of its side walls to a strap which curves up and over the edge of the eaves trough allowing the scoop portion to be placed upon the eaves trough when used. A handle is attached to the other end of the strap and extends a sufficient distance for an individual to grasp and clean the eaves trough while standing on the ground.

5 Claims, 4 Drawing Sheets

EAVES TROUGH CLEANER

BACKGROUND OF THE INVENTION

The present invention relates to a device for cleaning debris from eaves troughs or gutters.

When cleaning eaves troughs on the roofs of buildings, an individual usually climbs a ladder to gain access to the eaves trough located at the edge of the roof. After cleaning the area along the eaves trough within his or her arm's reach, the individual must then climb down the ladder and move it to clean another area. This process takes considerable time, is inconvenient, and is also dangerous due to the risk of bodily injury from falling off the ladder.

It is an object of the present invention to provide a device for cleaning such eaves troughs while the individual stands on the ground and thus eliminating the use of a ladder.

SUMMARY OF THE INVENTION

The present invention is directed to an eaves trough cleaner that comprises a head defining a bucket or scoop portion. The scoop portion has a flat rectangular bottom, an upstanding back wall, and opposite side walls. The bottom and side walls have a plurality of teeth or fingers formed at the front ends with two of the teeth on the bottom extending longer than the remaining teeth. The scoop portion is attached at one of its side walls to a strap which curves up and over the edge of the eaves trough allowing the scoop to fit into the gutter when used. A handle is then attached to the other end of the strap and extends a sufficient distance for an individual to grasp it and clean the eaves trough while standing on the ground.

BRIEF DESCRIPTION OF THE DRAWINGS

These and other features, aspects and advantages of the present invention will become better understood with regard to the following description, appended claims, and accompany drawings where:

DETAIL DESCRIPTION OF THE INVENTION

Figure 1:
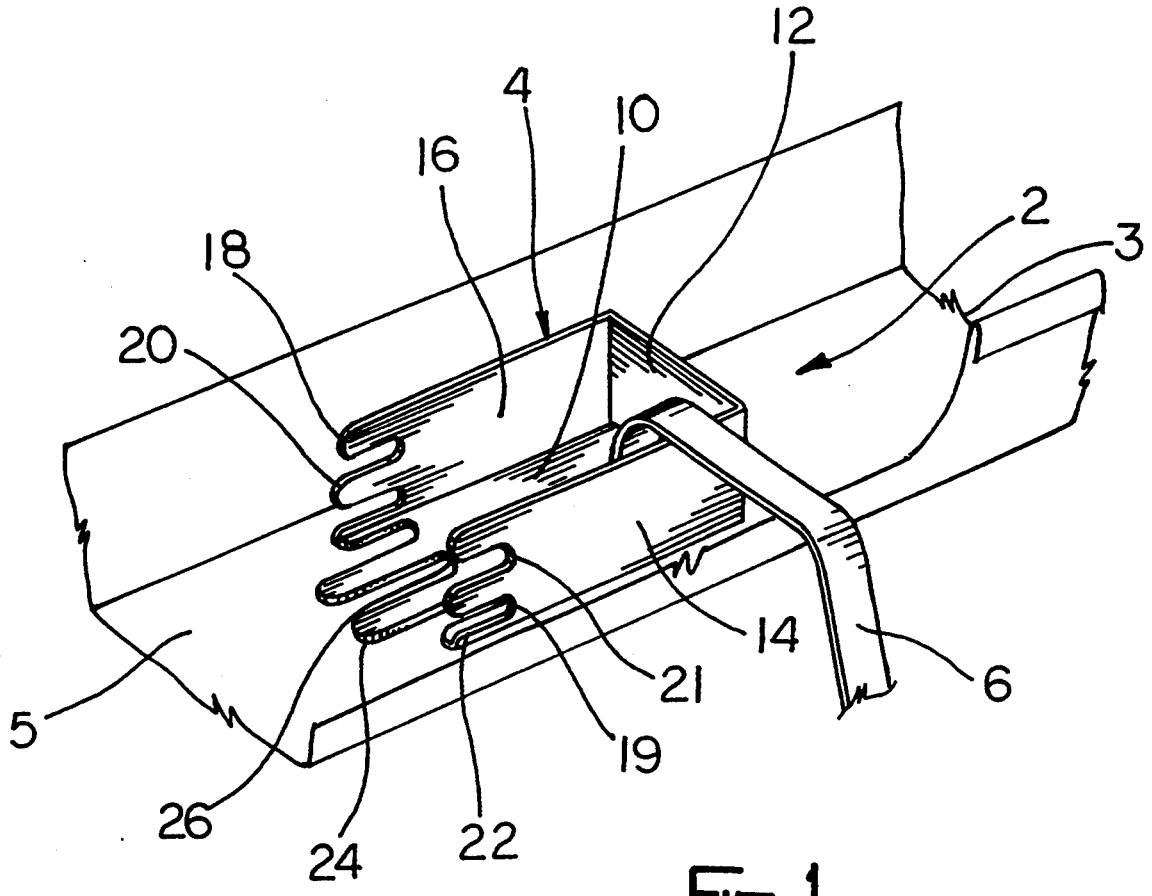
FIG. 1 shows a top perspective view of the eaves trough cleaner without the handle and placed in a gutter.
Figure 2:
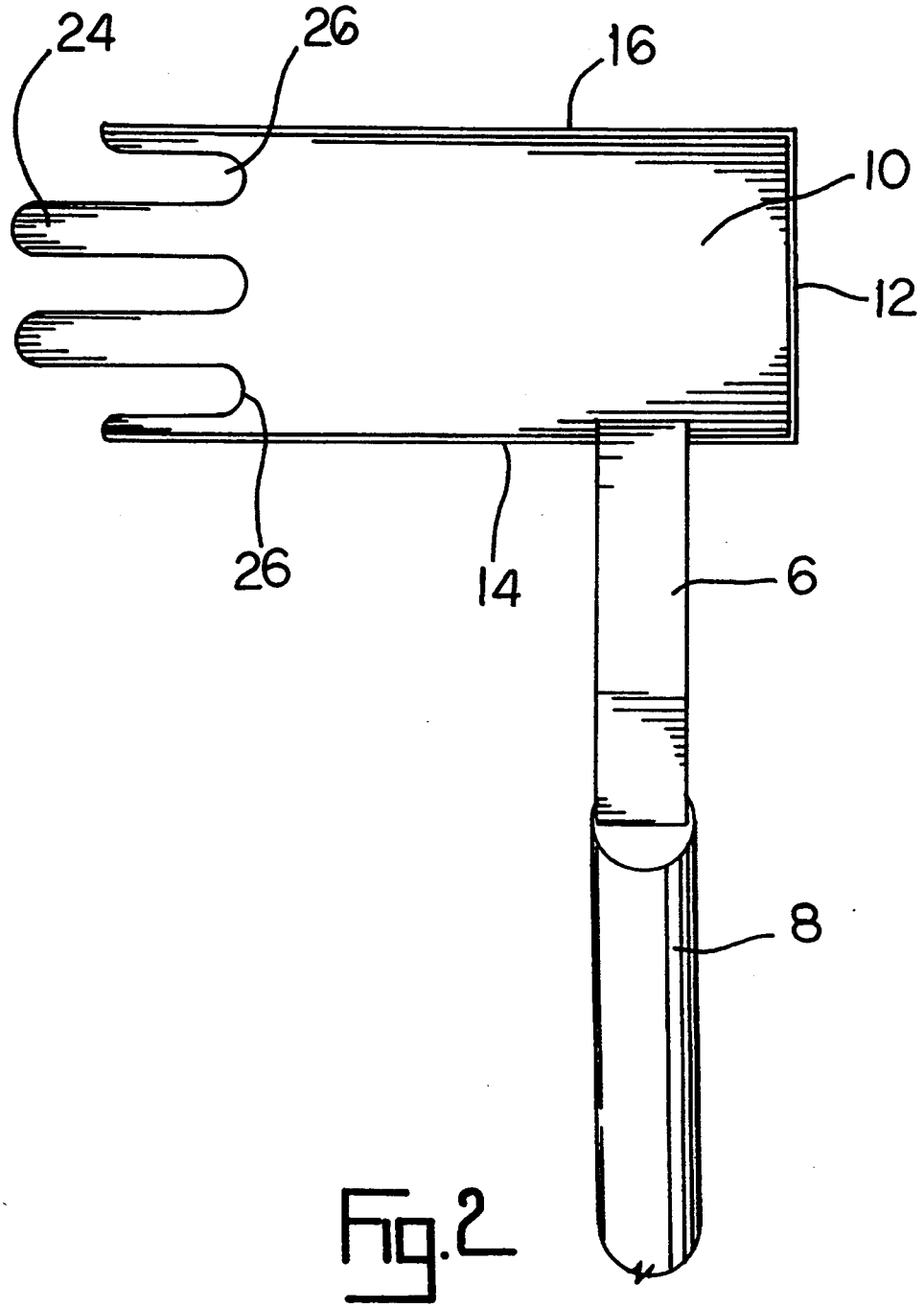
FIG. 2 shows a top view of the eaves trough cleaner.
Figure 3:
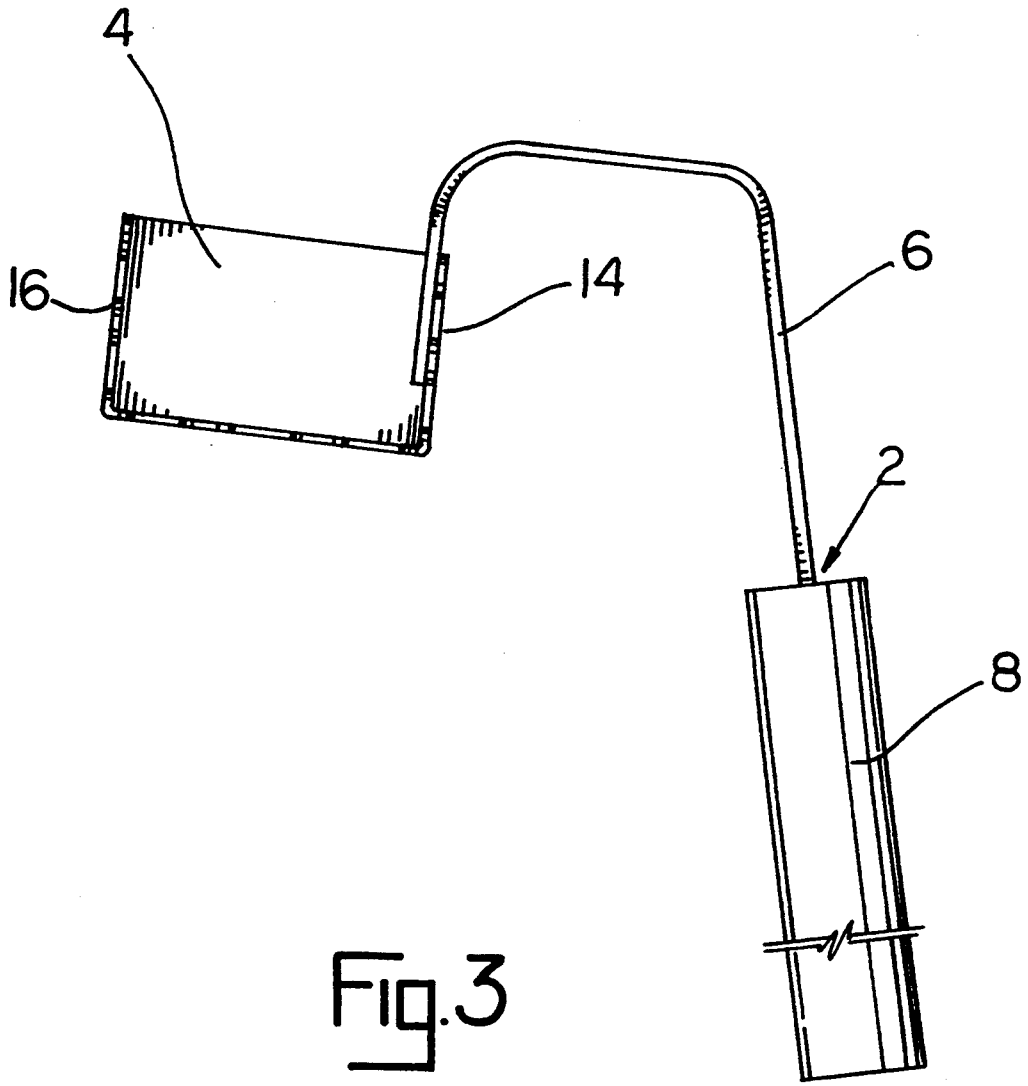
FIG. 3 shows a front view of the eaves trough cleaner.
Figure 4:
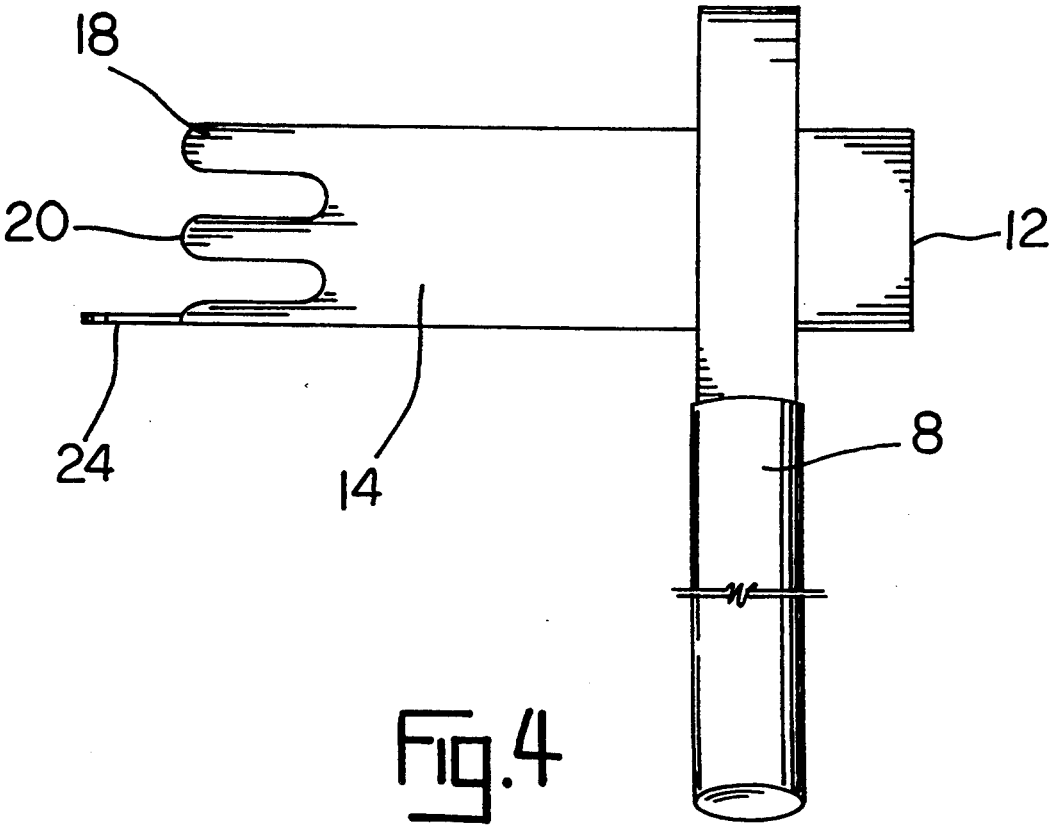
FIG. 4 shows a right side of the eaves trough cleaner.

Referring to FIGS. 1 and 3, the eaves trough cleaner 2 comprises a head defining a bucket or scoop portion 4, a strap 6 attached to the scoop portion 4 at one end and a handle 8 attached to the strap 6 at its other end. The scoop portion 4 has a flat rectangular bottom 10, upstanding back wall 12, and opposite side walls 14 and 16. Two inverted U-shaped teeth or fingers 18 and 20 are formed in a column along the front end of each of the side walls 14 and 16 as also seen in FIG. 4. The fingers extend planar with their associated side wall. The fingers are spaced apart by U-shaped recesses 19 and 21. These fingers aid in scraping up debris along the sides of the eaves trough and depositing it into the body of the scoop portion. As shown in FIGS. 1 and 2, four inverted U-shaped teeth fingers 22 and 24 are formed in a row along the front end of the bottom 10 with the two center fingers 24 extending approximately one-half inch beyond the other fingers 18, 20 and 24 to contact the curvature of the round eaves trough when the scoop portion 4 is used at a downward angle. The fingers extend planar with the bottom. The fingers are spaced apart by U-shaped recesses 26. At this position, the center fingers 24 scrape up leaves, twigs and other debris along the bottom of the eaves trough and deposit it into the body of the scoop portion. The scoop portion is small enough to get in between the spikes that hold the eaves trough in place. The scoop portion 4 is generally made from 16 gauge sheet metal; however, it should be understood that other materials such as aluminum or plastic can be used.

A looped strap 6 is welded to the inside of side wall 14 as shown in FIG. 3. It should be noted that the strap can be welded to the inside of side wall 16 if the gutter cleaner is used to clean from left to right as is the case for a left-handed person. The strap 6 is preferably made out of 10 gauge metal or other suitable material. The strap 6 curves up and over the side wall 14 and edge of the eaves trough 3 a sufficient distance such that the scoop portion 4 can contact the bottom 5 of the eaves trough when used as seen in FIGS. 1 and 3.

The other end of the strap 6 is attached to the elongated cylindrical handle 8. The handle 8 is oriented generally with its longitudinal axis being perpendicular with the longitudinal axis of the scoop portion 4. The handle 8 extends a sufficient distance for an individual to grasp and clean the eaves trough while standing on the ground. The handle 8 is generally composed of electrical conduit pipe or hardwood. An extension handle can be made by fastening a coupling and additional conduit pipe to the conduit pipe handle in a commonly known manner. The cleaner is designed to be used on a standard one story building with standard eight foot ceilings.

In operative use, an individual (not shown) grasps the handle 8 and positions the scoop portion 4 into the eaves trough such that the two center fingers 24 contact the bottom 5 of the eaves trough 3 as seen in FIG. 1. The individual then moves the cleaner along the eaves trough in the direction in which the teeth point scooping the debris into the body of the scoop portion. The scoop can be emptied on the ground or into a receptable when it is full of debris.

What is claimed is:

1. A tool for cleaning an eaves trough comprising:

a scoop portion having a flat bottom, a back wall, and opposite side walls, each of said side walls having a plurality of fingers extending generally planar with their associated side wall, said bottom having a plurality of fingers extending generally planar with said bottom; and a handle attached to said scoop portion such that said scoop portion can be placed upon the eaves trough while a user holds said handle and stands on the ground to clean said eaves trough.

2. A tool according to claim 1 wherein said fingers of said bottom are spaced apart from each other by U-shaped apertures, said fingers of each of said side walls being spaced apart by U-shaped apertures.

3. A tool according to claim 2 wherein at least one of said fingers of said bottom extends further than the other fingers.

4. The tool according to claim 1 including a strap attached between said scoop portion and said handle, said strap curving up and over the edge of said eaves trough a sufficient distance such that said scoop portion can be placed upon said eaves trough when in use.

5. A tool for cleaning an eaves trough comprising:

a scoop portion having a flat bottom, a back wall, and opposite side walls, each of said side walls having a plurality of fingers with U-shaped apertures therebetween extending generally planar with their associated side wall, said bottom having a plurality of central and side fingers with U-shaped apertures therebetween extending generally planar with said bottom, said central fingers of said bottom extending farther than said side fingers of said bottom; and a handle attached to said scoop portion such that said scoop portion can be placed upon the eaves trough while a user holds said handle and stands on the ground to clean said eaves trough.

* * * * *